US005758467A

United States Patent [19]

Snear et al.

[11] Patent Number: 5,758,467

[45] Date of Patent: Jun. 2, 1998

[54] INTER-CONNECTABLE, MODULAR, DECK MEMBER

[75] Inventors: S. Clayton Snear, Houston, Tex.; Larry G. Keller, York, Nebr.

[73] Assignee: North American Pipe Corporation, Houston, Tex.

[21] Appl. No.: 766,281

[22] Filed: Dec. 13, 1996

[51] Int. Cl.[6] ..... E04B 2/46

[52] U.S. Cl. ..... 52/592.1; 59/177; 59/650.3; 59/588.1

[58] Field of Search ..... 52/177, 588.1, 52/592.1, 650.3, 549, 543

[56] References Cited

U.S. PATENT DOCUMENTS

| | | | |
|---|---|---|---|
| 695,018 | 3/1902 | Wear . | |
| 2,670,060 | 2/1954 | Fenske . | |
| 2,809,017 | 6/1957 | Wong . | |
| 2,877,600 | 3/1959 | Slate . | |
| 3,524,292 | 8/1970 | Bogttom . | |
| 3,620,027 | 11/1971 | Nordell . | |
| 4,078,515 | 3/1978 | Svirklys . | |
| 4,137,682 | 2/1979 | Trumper . | |
| 4,198,795 | 4/1980 | Barnidge . | |
| 4,223,503 | 9/1980 | Hague . | |
| 4,226,064 | 10/1980 | Kraayenhof . | |
| 4,266,385 | 5/1981 | Oehlert . | |
| 4,312,166 | 1/1982 | Mock . | |
| 4,419,851 | 12/1983 | Kruger . | |
| 4,548,293 | 10/1985 | Haab . | |
| 4,819,398 | 4/1989 | Toti et al. . | |
| 4,845,907 | 7/1989 | Meek . | |
| 4,907,387 | 3/1990 | Turnbull . | |
| 4,964,618 | 10/1990 | Kennedy et al. . | |
| 5,009,045 | 4/1991 | Yoder . | |
| 5,048,448 | 9/1991 | Yoder . | |
| 5,050,361 | 9/1991 | Hallsten . | |
| 5,050,362 | 9/1991 | Tal et al. | 52/588.1 |
| 5,070,664 | 12/1991 | Groh et al. . | |
| 5,149,061 | 9/1992 | Borgnini . | |
| 5,274,977 | 1/1994 | Bayly . | |
| 5,412,915 | 5/1995 | Johnson . | |
| 5,647,184 | 7/1997 | Davis | 52/177 X |

OTHER PUBLICATIONS

A single sheet of photographs Nos. 1 & 2 depicting a "Teck Deck™", deck module design.

Vinyhlite Decking Installation brochure, VinylWorks, Inc. publication date unknown.

Sheerline Maintenance Free Deck System brochure, L.B. Plastics, Inc., publication date unknown.

Brock Dock brochure, Brock Manufacturing, 1992.

Vinylite Decking System brochure, Vinyl USA, Inc. publication date unknown.

*Primary Examiner*—Christopher Todd Kent
*Assistant Examiner*—Yvonne Horton-Richardson
*Attorney, Agent, or Firm*—Tobor & Goldstein, L.L.P.; Darin H. Duphorne; Ben D. Tobor

[57] ABSTRACT

A modular construction member for the construction of decking, flooring, roofing, and the like, including a matable connector formed integrally with the construction member for connecting successive deck members to form a deck assembly. The modular construction member includes a gutter portion and a groove portion, which may be interconnected to provide a substantially water-proof structure. A separate fastener may be passed through the gutter portion, the groove portion, and into a subfloor to further secure the structure and to withstand upward forces from, for example, wave action in a marine environment.

14 Claims, 3 Drawing Sheets

FIG.4
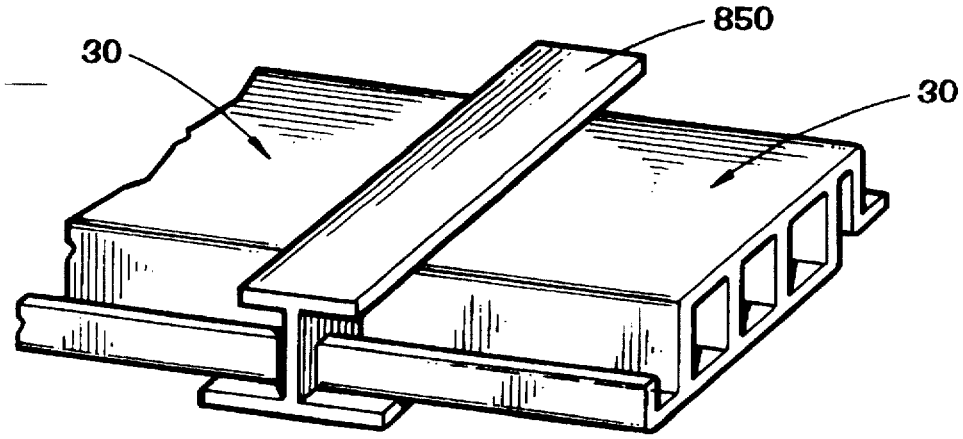
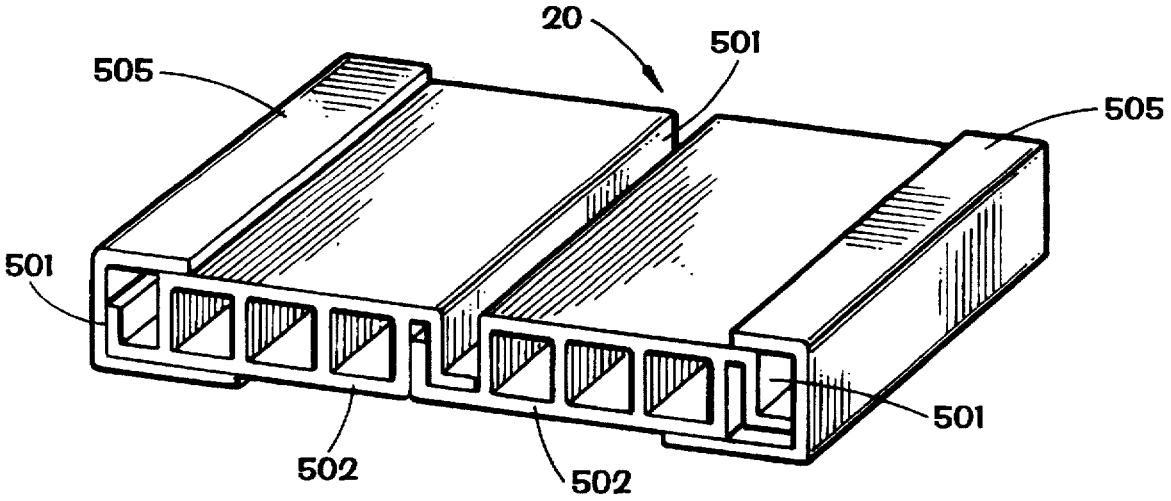
FIG.5

INTER-CONNECTABLE, MODULAR, DECK MEMBER

BACKGROUND OF THE INVENTION

1. Field Of The Invention

The invention relates to a modular construction member for the construction of decking, flooring, roofing, and the like.

2. Description Of The Prior Art

Prior modular construction members for the construction of decking, flooring, roofing, and the like typically utilize a plurality of panels fabricated from metallic and thermoplastic materials. A number of means for connecting the panels to one another have been utilized, including rivets, screws, nails, and similar fasteners. Similar means for connecting the panels to a foundation structure, or subfloor, have also been utilized.

Prior decks and flooring have traditionally been constructed from wooden materials, such as wooden planks. In such a prior deck or flooring, a subfloor may be provided either directly on a solid foundation or may be elevated, creating a second flooring structure above a foundation. The subfloor structure may, itself, be a solid structure or may provide minimal structural support for the decking, flooring, etc. Deck members, typically of wooden construction, may then be nailed, screwed, or otherwise fastened to the subfloor.

In typical deck construction using wooden materials, the deck members are mounted individually to the subfloor and are not connected to one another. Such a method of fastening may provide for easy mounting; however, should the fasteners fastening a particular deck member to the subfloor work loose or should the wood rot around the fasteners, the integrity of the deck at the location of that deck member may be compromised. Other materials, such as thermoplastic materials and metallic alloys, have been utilized to create interlocking, modular, deck members that assist in the ease of installation and maintain a degree of structural integrity upon failure of the separate fasteners.

Typical wooden decking must also include substantial gaps between deck members to provide for expansion and contraction due to the response of wood to changes in moisture and temperature. Because such gaps do not prevent water or other fluids from passing through the decking, wooden decking may create substantial problems where it is desirable to prevent fluids from passing therethrough. For example, using such deck members to create a second floor would not allow a first floor to remain dry; nor would such use allow control of runoff for contaminants in an environmentally sensitive application.

Prior interlocking, modular, deck members have incorporated various means for connecting successive modules, or deck members to one another and to the subfloor. Such means for connecting the modules to one another include interference fit, snap-fit, and other combinations of interlocking fittings. Such fittings typically create snug connections between deck members. Such fittings may make undesirable noises, such as squeeks, when forces are applied at or near the location of the snug fitting. Snug fitted deck members may not allow for thermal expansion and/or contraction upon heating and/or cooling of the deck members and may also cause difficulties in installation. Deck member modules are typically connected to the subfloor by the use of separate conventional fasteners such as nails, screws, or rivets which may pass through a portion of a deck member to connect the deck member to the subfloor. Typically, the fastener is passed through a portion of the deck member extending between successive deck members and accessible through a gap between the deck members. Thus, the fasteners are not located on the surface of the deck structure and separate access holes or areas are not necessary through the upper deck surface. As a result, prior deck modules are typically connected to the subfloor at only one edge of each deck member, or module. Therefore, the end not connected to the subfloor is retained vertically only by the snap-fit, interference fit, or other interlocking means connecting the successive panels, or modules, to one another. Such prior deck systems have proven to have insufficient strength to prevent damage to the deck structure in the event of excessive wave action, acting upon the underside of the deck system, for example, when the deck system is used as decking for a pier, a boat dock, or some other similar structure.

Accordingly, prior to the development of the present invention, there has been no modular construction member which: is simple and economical to manufacture; is easily and quickly utilized; is effective to inter-connect successive deck members without separate fasteners; provides lateral adjustability of a structure comprised of inter-connected deck members; provides a channel or groove for drainage of fluids, which includes non-contacting interlocking means; and which provides for simultaneously securing both edges of successive deck members to the subfloor. Therefore, the art has sought an adjustable-width panel assembly which: is simple and economical to manufacture; is easily and quickly utilized; is effective to inter-connect successive deck members without separate fasteners; provides lateral adjustability of a structure comprised of inter-connected deck members prior to fastening of the deck structure to the subfloor; provides a channel or groove for drainage of fluids, which includes non-contacting interlocking means; and which provides for simultaneously securing both edges of successive deck members to the subfloor.

SUMMARY OF THE INVENTION

A feature of the present invention is that, when successive deck members are inter-connected to span a distance such as a length of subfloor to be covered, the cumulative lateral movement of all deck members may provide a degree of lateral movement prior to final connection to the subfloor with separate fasteners, if desired. Such movement over a portion of the spanned distance may be sufficient to close a gap which may be present between the final deck member and, for example, an end cap or point of abutment. Provision of such lateral movement may decrease the close tolerances otherwise required and the need for the precise calculations and care generally associated with placement of deck members. In addition, such lateral movement may, in a particular application, eliminate the need for lengthwise cutting of a final deck member.

An additional feature of the present invention is that the interlocking, modular, deck members of the present invention may provide a partially waterproof deck or floor that may provide for minimal contact between successive deck members so that undesirable squeeks or other sounds may be minimized or eliminated upon exertion of force at or near a point of interconnection.

An additional feature of the present invention is that the separate fasteners used to connect the successive deck members to a subfloor pass through portions of each of two successive deck members, thereby providing support from upward movement due to wave-action or some other upward force.

In accordance with the invention, some of the foregoing advantages have been achieved through the present deck assembly adapted to be attached to a subfloor. The deck assembly may be formed from a plurality of successive deck members including at least one first deck member and at least one second deck member, the at least one first deck member secured to a successive at least one second deck member by mating means, the mating means including: a gutter, formed integrally with the at least one second deck member and shaped to receive a foot member of the at least one first deck member; a foot member, formed integrally with the at least one first deck member and disposed within the gutter of the at least one second deck member; and a fastener, sealingly disposed through the foot member and the gutter and extending into the subfloor, thereby securing the successive deck members to one another and the subfloor and providing a substantially water-proof connection between successive deck members. The fastener may be sealingly disposed through and within the foot member.

In accordance with another aspect of the invention, some of the foregoing advantages have been achieved through the present deck assembly adapted to be attached to a subfloor, comprising: at least one first deck member, each at least one first deck member having a length, first and second side portions, a body portion, a deck surface portion, a base, and a female connecting portion formed integrally with, and proximate to, the second side portion, the female connecting portion being disposed between the deck surface portion and the base of the at least one first deck member; at least one second deck member, each at least one second deck member having a length, first and second side portions, a body portion, a deck surface portion, a base, and a male connecting portion formed integrally with, and proximate to, the first side portion, the male connecting portion being disposed between the deck surface portion and the base of the at least one second deck member; and mating means for connecting the male connecting portion of the at least one first deck member to the female connecting portion of the second deck member, whereby the at least one first and second deck members are initially laterally movable relative to one another such that the width of the modular deck structure is adjustable upon lateral movement of at least one panel member.

The deck assembly of the present invention may include: a gutter, formed integrally with the female connecting portion of the at least one second deck member and shaped to receive a foot member of the male connector of the at least one first deck member; and a foot member, formed integrally with male connecting portion of the at least one first deck member and disposed within the gutter of the female connecting portion of the at least one second deck member.

The deck assembly may further include a fastener, disposed through the foot member and the gutter and extending into the subfloor. Further, the male connecting portion may include a male connector disposed proximate the male connecting portion of the at least one first deck member and the female connecting portion includes a female connector disposed proximate the female connecting portion of the at least one second deck member.

A further feature of the present invention is that the the male connector may include a leg arm formed integrally with and extending generally horizontally away from the body portion of the at least one first deck member, a leg formed integrally with and extending generally downward from the leg arm, and a foot member formed integrally with and extending generally horizontally from the leg; the female connector may also include a gutter, formed integrally with and extending generally in the direction of the at least one first deck member, the gutter defined by a finger arm, formed integrally with and extending generally horizontally away from the body portion of the second deck member; and a finger may be formed integrally with and extending generally upward and away from the finger arm, whereby at least a portion of the leg and foot portions of the male connector of the at least one first deck member are insertable into the gutter of the female connector of the second deck member.

A further feature of the present invention is that the male connector of the at least one first deck member may initially be loosely engageable with the female connector of the second deck member, to loosely interconnect the at least one first and second deck members such that the at least one first and second deck members may be laterally moveable relative one another. An additional feature of the present invention is that the male connector of the at least one first deck member may initially be loosely engageable with the female connector of the second deck member, to loosely interconnect the at least one first and second deck members such that each of the inter-connected panel members is laterally moveable relative one another and including a fastener disposed through a portion of the foot of the male connector, a portion of the finger arm of the female connector, and a portion of the subfloor, thereby fixedly attaching the deck assembly to the subfloor.

An additional feature of the present invention is that the body portion, the leg arm, and the leg of the at least one first deck member may be spaced-apart from the finger of the second deck member, and the leg of the at least one first deck member may be spaced-apart from the body portion of the second deck member. The deck assembly of the present invention may further include a fastener, disposed through the foot member and the gutter and extending into the subfloor, thereby securing the at least one first and second deck members to one another and to the subfloor.

In accordance with another aspect of the present invention, some of the foregoing advantages have also been achieved through an integrally formed deck member, having first and second side edges with a length, for a modular deck assembly, comprising: a body portion, including a base; a deck surface portion; and a strut portion, which includes a gutter strut, a groove strut, and at least one intermediate supporting strut, to support the deck surface portion; a first connector portion, comprising a gutter portion disposed along substantially the entire length of the first side edge and having a gutter extending beyond the gutter strut; and a second connector portion, comprising a groove portion disposed along substantially the entire length of the second side edge and having a groove extending beyond the groove strut.

The gutter portion of the present invention may further be comprised of: a gutter strut; a finger arm, extending generally away from the gutter strut and having a gutter floor formed thereon; and a finger extending generally upward from the finger arm. The gutter portion may also be comprised of: a groove strut; a leg arm, extending generally away from the groove strut and having a groove ceiling formed thereon; a leg, extending generally downward from the leg arm and having an inner leg surface and an outer leg surface; and a foot member, extending generally away from the leg generally in the same plane as the finger arm.

The present invention may further be directed to a method of constructing a deck, comprising the steps of: providing a subfloor; providing at least one first deck member proximate the subloor, the at least one first deck member having a groove portion formed integrally therewith, the groove portion including a leg arm, a leg, a foot member, a groove strut, and a groove defined by the leg groove strut, the leg arm, and the leg; providing at least one second deck member proximate the subfloor, the at least one second deck member having a gutter portion formed integrally therewith, the gutter portion including a gutter strut, a finger arm, a finger, and a gutter defined by the gutter strut, the finger arm, and the finger; placing the foot member of the at least one first deck member within the gutter of the at least one second deck member, whereby the finger of the gutter portion extends into and is disposed within the groove of the groove portion; providing at least one fastener; and disposing the at least one fastener through the foot member of the first deck member, through the gutter of the second deck member, and into the subfloor.

The inter-connecting, modular, deck member of the present invention, when compared with previously proposed inter-connecting, modular, deck members, has the advantages of being simple and economical to manufacture, being easily and quickly utilized, being effective to interconnect successive deck members with minimal contact between successive deck members, providing lateral adjustability of the resulting structure prior to final fastening of the deck members to the subfloor, providing a channel or groove for drainage of fluids, and providing support from upward movement due to wave-action or some other upward force.

BRIEF DESCRIPTION OF THE DRAWINGS

In the drawings:

FIG. 4 is a partial perspective view of two deck members, in accordance with the present invention, placed in end-to-end relation, and having a T-rail disposed therebetween;

FIG. 5 is a perspective view of a deck assembly, in accordance with the present invention, showing an end cap disposed disposed along each side edge.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF SPECIFIC EMBODIMENTS

Figure 1:
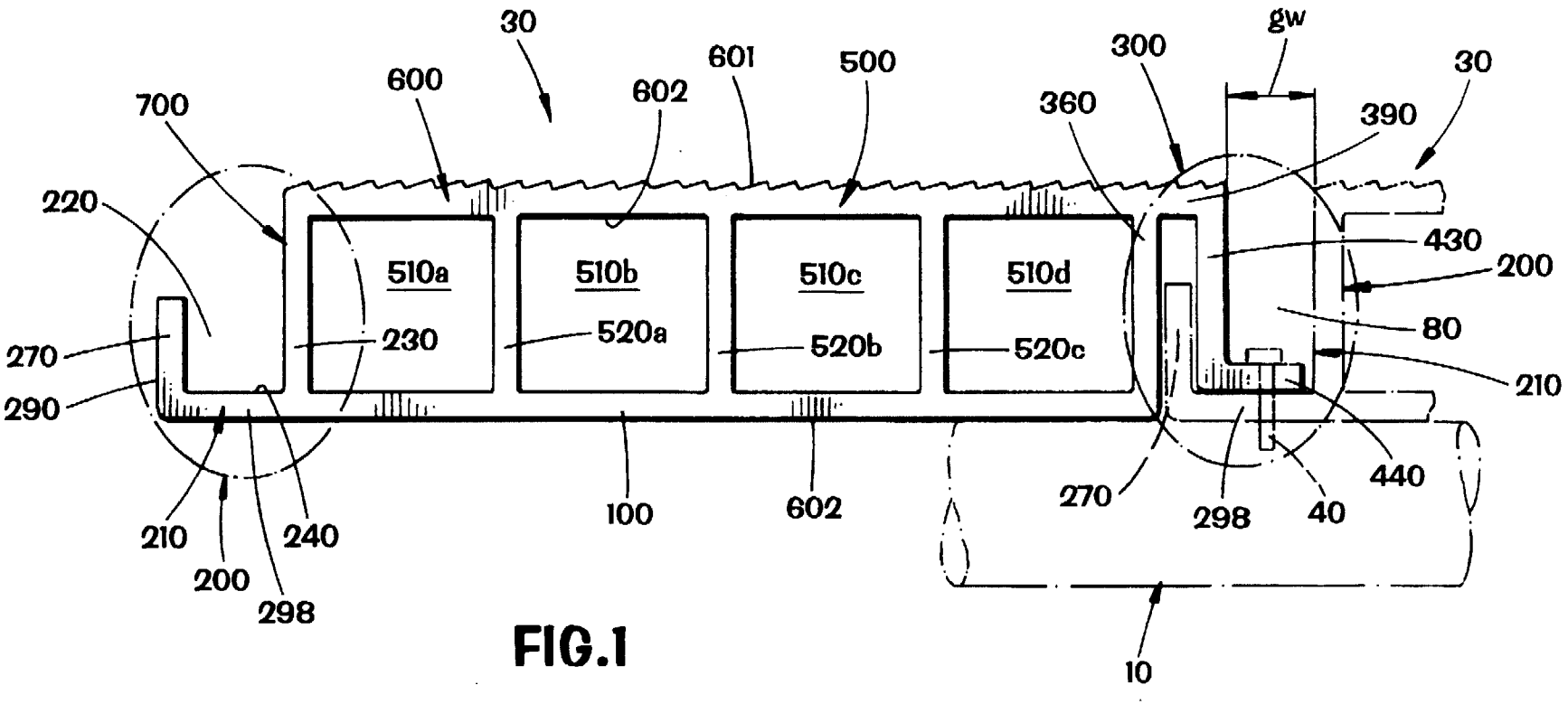
FIG. 1 is an end view of a deck member, in accordance with the present invention.

Referring to FIG. 1, an inter-connectable deck member 30, in accordance with the present invention, is shown. In a preferred embodiment, the deck member 30 is preferably extruded from polyvinyl chloride (PVC); however, the deck member 30 may also be manufactured using any suitable thermoplastic material, such as polypropylene, polyethylene, low density polyethylene (LDPE), vinyl acetate copolymers, vinyl chloride monomers (VCM), or acrylonitrile-butadiene-styrene (ABS), which has the requisite durability, strength, and flexibility characteristics, which may be necessary for the invention as hereinafter described.

Figure 3:
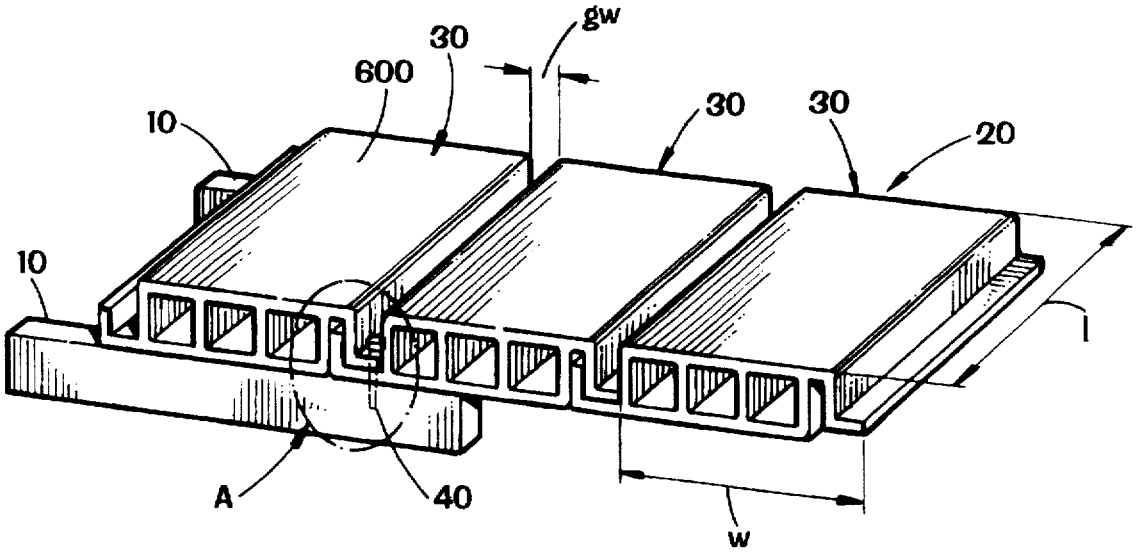
FIG. 3 is a perspective view of a deck assembly, in accordance with the present invention, showing three successive, inter-connected deck members, and showing a portion of the subfloor on which the deck assembly is attached.

FIG. 3 shows a deck member 30 interconnected with second and third deck members 30 to comprise a deck assembly 20, which is intended to be fixed to a subfloor, or supporting structure, 10 by the use of separate fasteners 40. Three successive deck members 30 are shown to comprise deck assembly 20. However, deck assembly 20 may comprise any number of deck members 30 as desired to form a deck assembly 20 of a suitable size for a particular application. The subfloor, or supporting structure 10, can be solid flooring, or it may be a supporting structure having only a minimal design to support the deck members 30 of the present invention.

Referring again to FIG. 1, an integrally formed deck member 30 is shown, which has a length l (FIG. 3), a unit width w (FIG. 3), a body portion 500, a first connector portion 200, and a second connector portion 300. The body portion 500 comprises a base 100 and a deck surface portion 600. The deck surface portion 600 is supported by a strut portion 700 disposed between the base 100 and the deck surface portion 600. A preferred embodiment includes a strut portion 700 comprised of a gutter strut 230, a groove strut 360, and three intermediate supporting struts 520*a*, 520*b*, and 520*c*. However, any suitable number of intermediate supporting struts may be used to provide support for a deck member 30 having a desired unit width for a particular application. In the embodiment shown in FIG. 1, a channel 510*a* is defined by gutter strut 230, strut 520*a*, base 100, and deck surface portion 600. Similarly, channel 510*b* is defined by strut 520*a*, strut 520*b*, base 100, and deck surface portion 600. Likewise, channel 510*c* is defined by strut 520*b*, strut 520*c*, base 100, and deck surface portion 600. Additionally, channel 510*d* is defined by strut 520*c*, groove strut 360, base 100, and deck surface portion 600. The channels 510*a*, 510*b*, 510*c*, and 510*d* are provided to minimize the weight of the resulting deck assembly 20 to minimize the cost of materials required to manufacture deck member 30 and provide structural rigidity. Deck surface portion 600 comprises upper deck surface 601 and lower deck surface 602. Upper deck surface 601 may be textured, etched, or coated with materials to provide traction and to facilitate runoff of water or other fluids from the upper deck surface 601.

Figure 2:
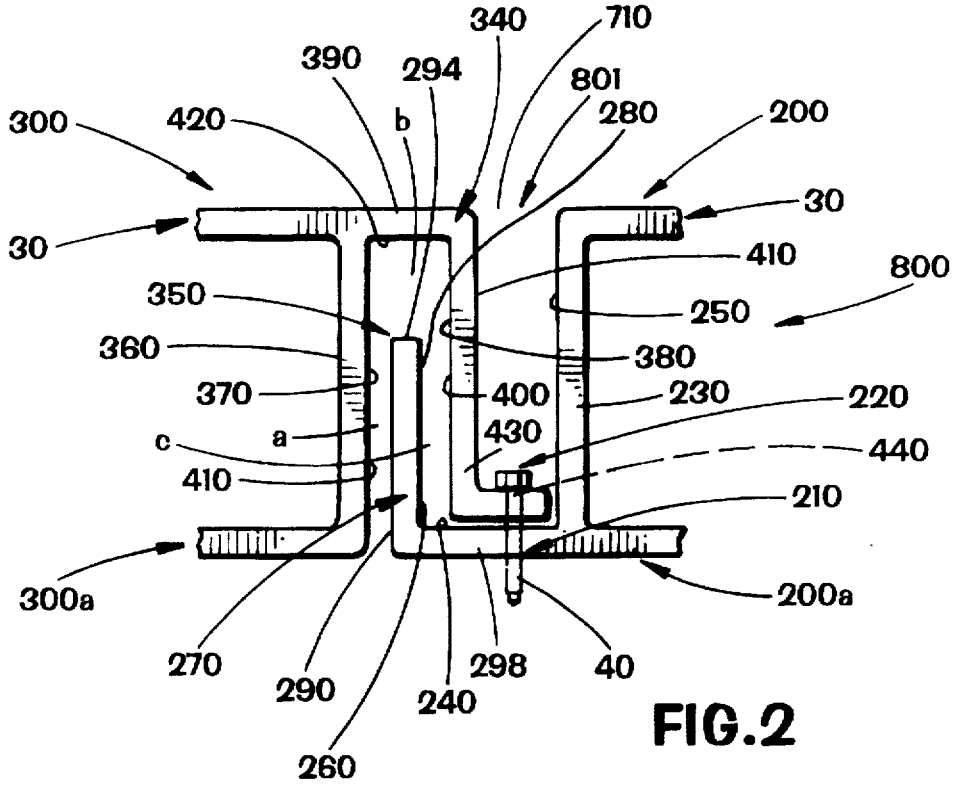
FIG. 2 is an exploded end view of two interconnected deck members of FIG. 1 forming a deck assembly as shown in FIG. 3, taken along arrow A of FIG. 3, illustrating a matable means including a male connector portion and a female connector portion, in accordance with the present invention.

Referring now to FIG. 2, first connector portion 200 is shown. In the preferred embodiment shown in FIGS. 1 and 2, first connector portion 200 of a second deck member 30 comprises a female connector 200*a*. Female connector 200*a* includes a gutter portion 210, which is comprised of: gutter strut 230; finger arm 298 extending generally away from gutter strut 230 and having gutter floor 240 formed thereon; and finger 270 extending generally upward from finger arm 298 and having an inboard finger surface 280, an outboard finger surface 290, and a finger end 294. Inboard finger surface 280 also defines an outboard gutter wall 260. Similarly, inboard gutter wall 250 is formed on gutter strut 230. Outboard gutter wall 260, inboard gutter wall 250, and gutter floor 240 define gutter 220, which is adapted to receive portions of the male connector 300*a* of a successive first deck member 30 to be described in detail hereinafter.

Still with reference to FIGS. 1 and 2, second connector portion 300 of first deck member 30 is shown. In the preferred embodiment shown in FIGS. 1 and 2, second connector portion 300 comprises a male connector 300*a*.

Male connector 300*a* includes a groove portion 340, which is comprised of: groove strut 360; leg arm 390, extending generally away from groove strut 360 and having a groove ceiling 420 formed thereon; leg 430, extending generally downward from leg arm 390, having an inner leg surface 400 and having an outer leg surface 410; and foot member 440, extending generally away from leg 430 generally in the same plane as finger arm 298. Leg arm 390 extends generally away from body portion 500 of the deck member with which it is integrated and in a plane generally perpendicular to and above the plane in which finger 270 lies.

The naming convention used for female connector 200*a* and male connector 300*a* is not intended to limit the scope of the invention. Further, certain aspects of male connector 300*a* may receive portions of female connector 200*a*. However, female connector 200*a* and male connector 300*a* are so named because female connector 200*a* is adapted to generally receive foot member 440 and leg 430 of male connector 300*a* within gutter 220. Successive deck members are substantially identical to one another.

Still with reference to FIG. 2, male connector 300*a* of first deck member 30 is shown in mating engagement with its female counterpart, female connector 200*a*, of a successive second deck member 30. Successive deck members 30 are initially held in loose mating engagement by initially loosely engageable mating means 800, which will now be described in detail. By way of example, a single initially loosely engageable means 800, will be described, which includes the male connector 300*a* of a single first deck member 30 and the female connector 200*a* of a single successive second deck member 30.

Mating means 800 is shown in FIG. 2 to include a male connector 300*a* of first deck member 30 and a female connector 200*a* of second deck member 30. The leg 430 and foot member 440 of male connector 300*a* of first deck member 30 is inserted into the gutter 220 of second deck member 30 such that the finger 270 second of deck member 30 is disposed within the groove 350 of first deck member 30 and foot member 440 is disposed in contact with gutter floor 240, whereby male connector 300*a* of first deck member 30 overlaps female connector 200*a* of second deck member 30.

Finger 270 is disposed within groove 350. The thickness and dimensions of the connectors 300*a* and 200*a* are selected such that space a is provided between finger 270 and the inboard groove wall 370. Similarly, space b is provided between the finger end 294 and the groove ceiling 420 and space c is provided between the finger and the outboard groove wall 380, whereby finger 270 is substantially loosely disposed between groove 350. Although it is recognized that a portion of finger 270 may come into contact with portions of connector 300*a*, it is desirable to minimize such contact. In any event, successive deck members 30 are not secured to one another solely by any engagement of finger 270 within connector 300*a*.

Final installation includes use of separate fastener 40 to secure foot member 440 of first deck member 30 to the gutter floor 240 of second deck member 30. Separate fastener 40 is the primary means of securing successive deck members 30 to one another and to the subfloor 10. The loose connection of matable means 800 provides a temporary, loose, connection to assist in installation and provides secondary lateral support in the event that fastener 40 should fail. Additionally, matable means 800 provides a substantially waterproof connection between successive deck members 30 while providing a fastener access means 801, which may include a fastener access space 801, to allow for easy installation and removal of fastener 40. Fastener access means 801 comprises gap 710, having a gap width gw (FIG. 3), and defined by the space between outer leg surface 410 of deck member 30 and the inboard gutter wall 250 of second deck member 30. Fastener 40 may be a screw, a nail, or any other standard decking fasteners. At least one fastener 40 is provided through gap 710 and is passed through foot member 440 of deck member 30, gutter floor 240 of second deck member 30, and through or into subfloor 10, thus securing both the second connector 300*a* and first connector 200*a* directly to the subfloor to provide support of the resulting deck assembly 20 from upward forces such as from wave action when the deck assembly 20 is used in a marine environment. At least one fastener should be used to connect successive inter-connected deck members 30 However, multiple fasteners may be used along the length 1 (FIG. 3) of deck assembly 20 to further secure deck assembly 20. In addition, fastener 40 may be sealingly, or snugly, disposed through foot member 440 and gutter floor 240 within gutter 220 to enhance the water-resistance of deck assembly 20. The clearances provided may prevent or minimize squeeking or other undesirable noises associated with prior deck assemblies. In addition, where fastener 40 is a screw, slotted holes (Not Shown) may be provided in either or both of the foot member 440 and the gutter floor 240 of deck members 30 to provide for lateral contraction and/or expansion of the deck members without undue loss of structural integrity.

Referring now to FIG. 4, a T-rail 850 of the present invention is shown disposed between two deck members 30 that have been placed in end-to-end relation. Such end-to-end placement may be desired where an installation requires a deck assembly 20 (FIGS. 3 and 5) having a length 1 (FIG. 3) greater than the length 1 (FIG. 3) of available deck members 30. Additionally, T-rail 850 may be provided in applications in which it is desirable that deck members 30 be installed in angular end-to-end relation such as a mitered corner (not shown). Use of a T-rail 850 may conceal imperfectly cut edges of a deck member 30 and may also improve appearance of the overall deck assembly 20.

Referring now to FIG. 5, side edges 501 and end edges 502 of deck members 30 may be provided with an end cap 505, as shown disposed along the length of the side edges 501 of a single deck member 30. It should be noted that only two deck members are shown in FIG. 5. However, it is contemplated that multiple deck members 30 may comprise a deck assembly 20. Therefore, end cap 505 may be used along the length of an assembly 20 of any number of deck members 30. Additionally, an end cap 505 as shown in FIG. 5 may be disposed along the end edge 502 of deck assembly 20 (not shown).

Once the deck assembly 20 of the present invention is installed gutter 220 provides a substantially water-proof deck assembly 20. The loose connection provided between deck members additionally provides room for expansion not only of the deck assembly 20; rather, the loose connection also provides expansion of water or other fluids that might be contained within the mating means 800 should that water or fluid freeze in severe weather conditions, thus preventing or minimizing stuctural damage due to freeze-thaw cycles.

An embodiment of the present invention may also provide for lateral adjustability during installation to facilitate ease of installation. The operation of an embodiment of a deck member 30 of the present invention that provides for lateral adjustability of a deck assembly 20 may be better understood by way of the following description, which is to be understood as being presented for illustrative purposes only.

For example, using a deck assembly 20 consisting of 19 deck members 30, the width w of each deck member 30 being 5.825 inches, constructed so that that gap gw is 0.120 inches, the collapsed width of the entire deck assembly 20 equals 91.037 inches and the expanded width of the deck assembly 20 equals 93.097, thus providing a total expansion, or lateral adjustment, distance of 2.060 inches. Such expansion, or lateral adjustment, distance may allow for installation of a deck using the deck assembly 20 of the present invention without cutting of the deck members 30, in a particular application.

By utilizing an adjustable-width deck assembly, one may provide significant flexibility in the location of the supporting subfloor members to which the deck assembly may be connected. It should also be noted that the dimensions heretofore used are illustrative only and the exact dimensions used in a particular embodiment of an adjustable-width deck assembly may vary according to the size and configuration of the deck member desired, the materials used, and other factors.

It is to be understood that the invention is not limited to the exact details of construction, operation, exact materials, or embodiments shown and described, as obvious modifications and equivalents will be apparent to one skilled in the art; for example, any number of panel members may be adjustable, with some panel members being non-adjustable. Further, any suitable materials may be used and the surfaces of the present invention may include patterns such as to simulate, for example, woodgrain. Accordingly, the invention is therefore to be limited only by the scope of the appended claims.

What is claimed is:

1. A deck assembly adapted to be attached to a subfloor, comprising:

(a) a plurality of successive deck members including at least one first deck member and at least one second deck member, (b) the at least one first deck member secured to a successive at least one second deck member by a mating means, (c) the mating means including:

(i) a gutter, formed integrally with the at least one second deck member and shaped to receive a foot member of the at least one first deck member;

(ii) the foot member being formed integrally with the at least one first deck member and disposed within the gutter of the at least one second deck member; and (iii) a fastener, disposed through the foot member and the gutter floor, within the gutter, and extending into the subfloor, thereby securing the successive deck members to one another and the subfloor and providing a substantially waterproof connection between successive deck members.

2. The deck assembly of claim 1, wherein the fastener is sealingly disposed through the foot member, the gutter floor, and the subfloor.

3. A deck assembly adapted to be attached to a subfloor, comprising:

at least one first deck member, each at least one first deck member having a length, first and second side portions, a body portion, a deck surface portion, a base, and a female connecting portion formed integrally with, and proximate to, the second side portion, the female connecting portion being disposed between the deck surface portion and the base of the at least one first deck member;

at least one second deck member, each at least one second deck member having a length, first and second side portions, a body portion, a deck surface portion, a base, and a male connecting portion formed integrally with, and proximate to, the first side portion, the male connecting portion being disposed between the deck surface portion and the base of the at least one second deck member;

initially loosely engageable mating means for connecting the male connecting portion of the at least one first deck member to the female connecting portion of the second deck member; and a fastener, disposed through the foot member and the gutter floor, within the gutter, and extending into the subfloor, whereby the at least one first and second deck members are initially laterally movable relative to one another such that the width of the modular deck structure is adjustable upon lateral movement of at least one panel member.

4. The deck assembly of claim 3, wherein the initially loosely engageable mating means includes:

(a) a gutter, formed integrally with the female connecting portion of the at least one second deck member and shaped to receive a foot member of the male connector of the at least one first deck member;

(b) a foot member, formed integrally with male connecting portion of the at least one first deck member and disposed within the gutter of the female connecting portion of the at least one second deck member.

5. The deck assembly of claim 3, wherein the male connecting portion includes a male connector disposed proximate the male connecting portion of the at least one first deck member and the female connecting portion includes a female connector disposed proximate the female connecting portion of the at least one second deck member.

6. The deck assembly of claim 5, wherein the male connector includes a leg arm formed integrally with and extending generally horizontally away from the body portion of the at least one first deck member, a leg formed integrally with and extending generally downward from the leg arm, and a foot member formed integrally with and extending generally horizontally from the leg; wherein the female connector includes a gutter, formed integrally with and extending generally in the direction of the at least one first deck member, the gutter defined by a finger arm, formed integrally with and extending generally horizontally away from the body portion of the second deck member; and a finger formed integrally with and extending generally upward and away from the finger arm, whereby at least a portion of the leg and foot portions of the male connector of the at least one first deck member are insertable into the gutter of the female connector of the second deck member.

7. The deck assembly of claims 5, wherein the male connector of the at least one first deck member is initially loosely engageable with the female connector of the second deck member, to initially loosely interconnect the at least one first and second deck members such that the at least one first and second deck members are laterally moveable relative one another.

8. The deck assembly of claim 5, wherein the male connector of the at least one first deck member is loosely engageable with the female connector of the second deck member, to loosely interconnect the at least one first and second deck members such that each of the inter-connected panel members is laterally moveable relative one another and including a fastener disposed through a portion of the foot of the male connector, a portion of the finger arm of the female connector, and a portion of the subfloor, thereby fixedly attaching the deck assembly to the subfloor.

9. The deck assembly of claim 6, wherein the body portion, the leg arm, and the leg of the at least one first deck member are spaced-apart from the finger of the second deck member, and wherein the leg of the at least one first deck member is spaced-apart from the body portion of the second deck member.

10. The deck assembly of claim 9, including a fastener, disposed through the foot member and the gutter floor, within the gutter, and extending into the subfloor, thereby securing the at least one first and second deck members to one another and to the subfloor.

11. An integrally formed deck member, having first and second side edges each edge having a length, for a modular deck assembly, comprising:

a body portion, including: a base; a deck surface portion; and a strut portion, which includes a gutter strut, a groove strut, and at least one intermediate supporting strut, to support the deck surface portion;

a first connector portion, including a gutter portion disposed along substantially the entire length of the first side edge and having a gutter extending beyond the gutter strut;

a second connector portion, comprising a groove portion disposed along substantially the entire length of the second side edge and having a groove extending beyond the groove strut; and a fastener, disposed through the first and second connector portions, and extending into the subfloor.

12. The deck member of claim 11, wherein the gutter portion is comprised of:

a gutter strut;

a finger arm, extending generally away from the gutter strut and having a gutter floor formed thereon; and a finger extending generally upward from the finger arm.

13. The deck member of claim 12, wherein the groove portion is comprised of:

a groove strut;

a leg arm, extending generally away from the groove strut and having a groove ceiling formed thereon;

a leg, extending generally downward from the leg arm and having an inner leg surface and an outer leg surface; and a foot member, extending generally away from the leg generally in the same plane as the finger arm.

14. A method of constructing a deck, comprising the steps of:

providing a subfloor;

providing at least one first deck member proximate the subloor, the at least one first deck member having a groove portion formed integrally therewith, the groove portion including a leg arm, a leg, a foot member, a groove strut, and a groove defined by the leg groove strut, the leg arm, and the leg;

providing at least one second deck member proximate the subfloor, the at least one second deck member having a gutter portion formed integrally therewith, the gutter portion including a gutter strut, a finger arm, a finger, and a gutter defined by the gutter strut, the finger arm, and the finger;

placing the foot member of the at least one first deck member within the gutter of the at least one second deck member, whereby the finger of the gutter portion extends into and is disposed within the groove of the groove portion;

providing at least one fastener; and disposing the at least one fastener through the foot member of the first deck member, through the gutter of the second deck member, and into the subfloor.

* * * * *